US005124520A

United States Patent [19]

Spendlove

[11] Patent Number: 5,124,520

[45] Date of Patent: Jun. 23, 1992

[54] METHOD AND APPARATUS FOR DEVELOPING HEAT WITHIN CONDUCTIVE MATERIALS

[76] Inventor: Max J. Spendlove, 13121 Clifton Rd., Silver Spring, Md. 20904

[21] Appl. No.: 482,061

[22] Filed: Feb. 20, 1990

[51] Int. Cl.[5] ..... H05B 1/00

[52] U.S. Cl. ..... 219/50; 219/234

[58] Field of Search ..... 219/50, 90, 234

[56] References Cited

U.S. PATENT DOCUMENTS

| | | | |
|---|---|---|---|
| 1,807,004 | 5/1931 | Nelson . | |
| 1,869,448 | 8/1932 | Woodring . | |
| 2,001,538 | 5/1935 | Mueller et al. . | |
| 2,139,499 | 12/1938 | Howie . | |
| 2,226,194 | 12/1940 | Berolsky . | |
| 2,304,975 | 12/1942 | Warrender | 219/90 |
| 2,436,887 | 3/1948 | Hensley . | |
| 2,577,515 | 12/1951 | Durst | 219/90 |
| 2,969,449 | 1/1961 | Tyler . | |
| 3,412,233 | 11/1968 | Wilkie . | |
| 4,205,221 | 3/1980 | Meyer . | |
| 4,367,397 | 1/1983 | Henderson | 219/90 |
| 4,626,658 | 12/1986 | Gray et al. . | |

*Primary Examiner*—Clifford C. Shaw
*Attorney, Agent, or Firm*—Burns, Doane, Swecker & Mathis

[57] ABSTRACT

An electrically conductive work-piece is rapidly heated by establishing a current flow in the work-piece that is the highest it can be without damaging circuit components. Such components include at least a transformer having a high-voltage, low-current primary winding and a low-voltage, high-current secondary winding and insulated cables connected to the secondary winding and terminated in one or more clamps that attach to the workpiece. The cables may be jumper-type cables and the clamps may be alligator-type clamps. Other types of clamps suitable for use with the present invention include a sliding clamp, a hinged clamp, and a wrap-around strap-type clamp. To limit current in the circuit to acceptable levels, it may be necessary to employ one or more resistive electrodes, or heater blocks, placed in the jaws of one or more of the clamps. Intimate thermal contact is established between the heater blocks and the work-piece such that heat generated in the heater blocks is conducted to the work-piece. Heater blocks of different configuration and/or composition are provided to present a range of resistances. For a particular application, a resistance is selected that will limit current flow to a level that will not damage the workpiece, the transformer and cables or the heater blocks themselves. In an alternative embodiment of the present invention, a conventional current limiter is used instead of resistive electrodes such that the maximum allowable current is consistently maintained through the work-piece.

9 Claims, 9 Drawing Sheets

METHOD AND APPARATUS FOR DEVELOPING HEAT WITHIN CONDUCTIVE MATERIALS

BACKGROUND OF THE INVENTION

The present invention relates to a method and apparatus for developing heat within conductive materials and more particularly to such a method and apparatus wherein a large portion of the heat is developed by $I^2R$ heat energy within the material itself.

Numerous applications call for developing heat within a conductive material. Well-known examples of such applications include pipe-fitting wherein solder is melted to join copper pipe, sheet metal fastening wherein seams and overlaps are soldered, and thawing sections of frozen water pipes. Other less common applications of the present invention may include developing heat within such substances as fused electrolytes, semiconductors, powders, and mixes for whatever purpose necessary.

The best known method of heating in an application such as pipe-fitting and so forth is the use of a blow torch. The open flame produced by a blow torch, however, poses a conspicuous fire hazard, especially when used in proximity to combustible materials. To alleviate the safety hazards associated with blow torches, a number of different techniques have been proposed for electrically heating conductive materials. Such techniques typically involve the heating of resistive heating elements and conduction of heat from the heating elements to the work-piece. Because of thermal losses and poor heat transfer to the workpiece, the efficiency of such techniques is generally quite low and the time required to heat up the work-piece rather prolonged. Techniques are known wherein heat is generated in heating elements held in contact with a work-piece by the flow of electric current serially through the heating elements and the work-piece itself, as for example in U.S. Pat. No. 2,139,499. Such techniques have not concerned themselves, however, with maximizing the current through the work-piece such that the speed and efficiency of the heating operation may be optimally increased.

SUMMARY OF THE INVENTION

According to the present invention, a current flow is established in a current-flow path through a conductor by placing a pair of resistive electrodes in electrical contact and in intimate thermal contact with the conductor. Resistances of the resistive electrodes are selected such that current-flow is maximized within a rated limit of the current-flow path, preferably such that the rate of heat conduction from the resistive electrodes is not substantially less than the rate of resistive heating of the resistive electrodes.

By maximizing current flow through the conductor/-work-piece subject to the foregoing considerations, $I^2R$ heat energy in the work-piece is maximized and the accompanying resistive heating effect is accelerated. $I^2R$ heat developed in the resistive electrodes contribute to heating of the work-piece because of the intimate thermal contact between the electrodes and the work-piece.

DETAILED DESCRIPTION OF THE PREFERRED EMBODIMENT

Figure 1:
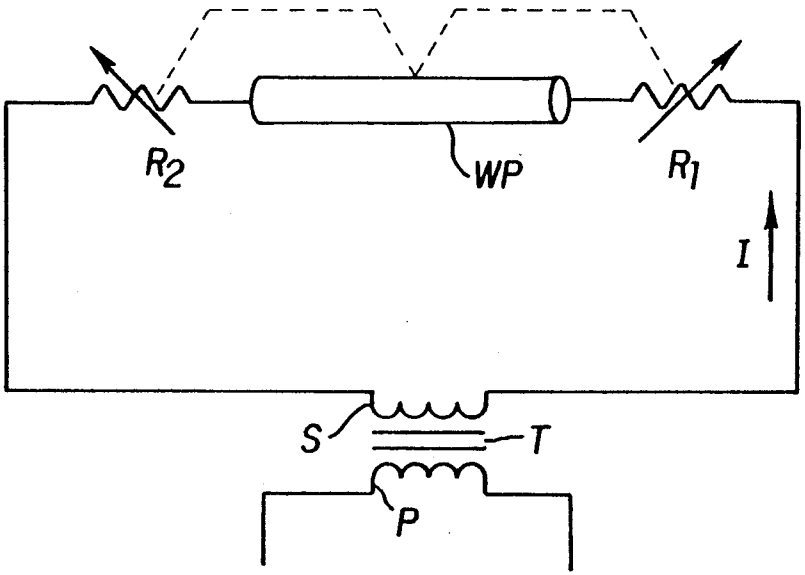
FIG. 1 is a schematic diagram illustrating the principle of the present invention.

Referring first to FIG. 1, the principle of the present invention will be explained. As is well-known, the flow of electrical current through a conductor produces "$I^2R$" heat energy which is proportional to the square of the current multiplied by the factor of the resistance of the conductor. This heat energy is generated within the conductor. This fact is advantageously employed according to the present invention to develop heat within a conductor for a variety of purposes.

In FIG. 1, a current I is supplied from a power transformer T having a high-voltage, low-current primary winding P and a low-voltage, high-current secondary winding S. The current I passes through the work-piece WP, causing $I^2R$ heat energy which rapidly and substantially increases the temperature within the work-piece WP. Since the work-piece WP will typically present a low resistance to the circuit, the current I is limited using selected or variable resistors $R_1$ and $R_2$. These resistors are then placed in intimate thermal contact (represented by dashed lines) with the work-piece WP such that heat generated within the resistors $R_1$ and $R_2$ is conducted to the work-piece WP.

The value of the resistors $R_1$ and $R_2$ is preferably chosen to limit the current I through the circuit to the optimum current rating with respect to the various components. Preferably, the transformer T and the conductors connecting the transformer through the resistors to the work-piece have sufficiently high current ratings such that neither of them imposes a limitation on the capacity of the other. Moreover, the current-carrying capacity of the work-piece WP will typically exceed the current-carrying capacity of the remainder of the circuit. Resistances $R_1$ and $R_2$ are therefore set in accordance with the optimum current limit with respect to the transformer and the conductors and the resistors themselves.

By maximizing current flow through the conductor/-work-piece subject to the foregoing considerations, $I^2R$ heat generated in the work-piece is maximized and the accompanying resistive heating effect is accelerated. $I^2R$ heat generated in the resistors $R_1$ and $R_2$ also contributes to the heating of the workpiece because of the intimate thermal contact between the resistors and the work-piece.

Heat is developed in the resistive elements (i.e., resistors $R_1$, $R_2$ and work-piece WP) by the current that flows through them. Since they are arranged in series, the same amount of current flows through each of them. Furthermore, the total resistance of the circuit is equal to the sum of the individual resistors so that:

$$R_T = R_1 + R_2 + R_3$$

wherein $R_T$ is total resistance; $R_1$ and $R_2$ are the resistances of resistors $R_1$ and $R_2$, respectively, and $R_3$ is the resistance of the work-piece.

Figure 2:
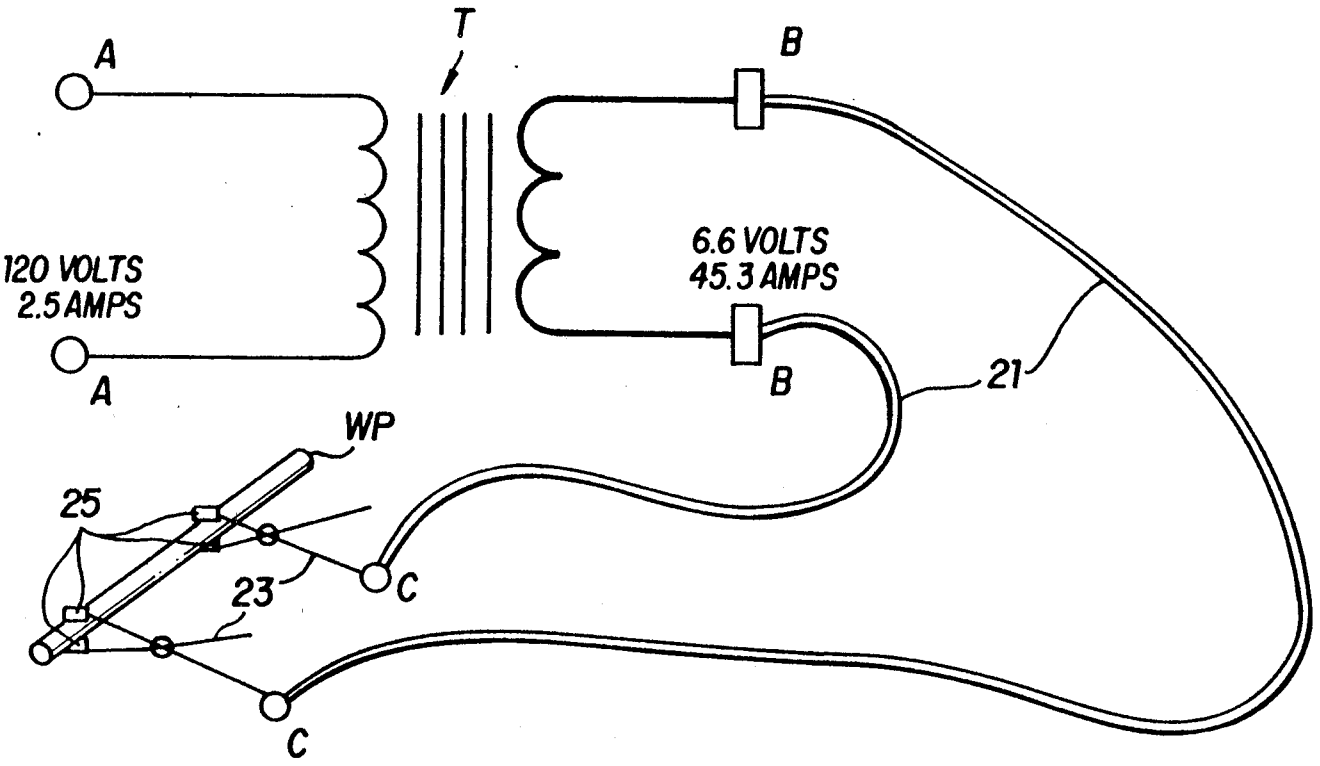
FIG. 2 is a circuit diagram of one embodiment of the present invention.

FIG. 2 illustrates a particular embodiment of an apparatus applying the principle understood from FIG. 1. A transformer T has 199 turns of #16 gauge copper enamel coated wire on the primary coil, 11 turns of #8 stranded cable comprising 19 bare #20 copper wire strands, and a core of laminated iron, and steps down conventional wall current at 120 volts, 2.5 amps at terminals A to 6.6 volts, 45.3 amps at terminals B. The potential at terminals B is conducted through insulated cables 21 to terminals C each formed by one of a pair of levers pivotally jointed near their center and spring tensioned to form gripping devices or clamps 23. The cables 21 may take the form of conventional jumper-type cables and the clamps 23 may take the form of conventional alligator-type clamps commonly used in conjunction with such cables. Fixed between the jaws of the clamps 23 are resistive electrodes or heater blocks 25, represented by resistors $R_1$ and $R_2$ in FIG. 1.

In the FIG. 2 embodiment, the total resistance is 0.146 ohms. The measured load is 300 watts with a primary current 2.5 amperes. The secondary current delivers 45 amperes to the cable connector terminals.

Figure 6A:
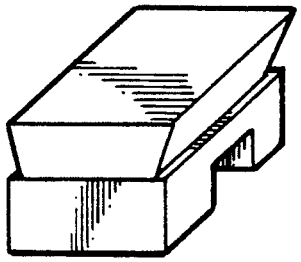
FIGS. 6*a* and 6*b* are illustrations of two different resistive heating blocks used interchangeably to vary the circuit resistance as shown in FIG. 1.
Figure 6B:
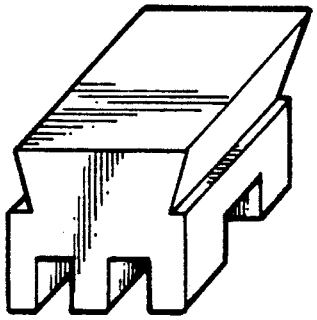
Figure 7A:
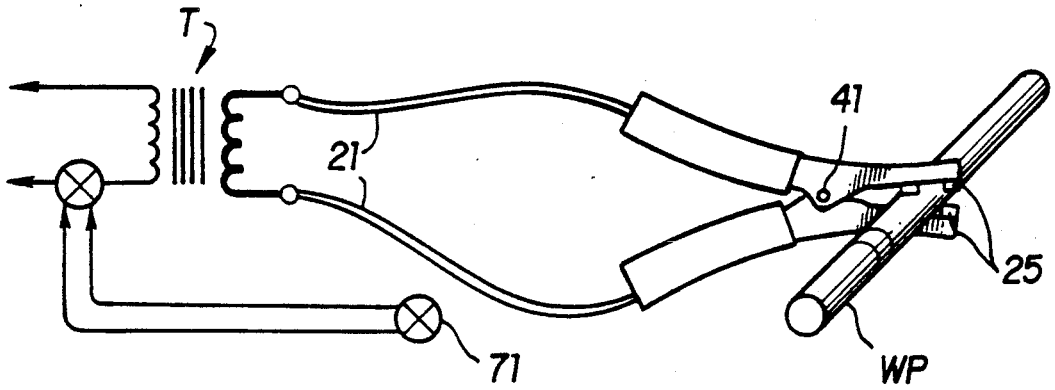
FIGS. 7*a*–7*d* are illustrations of different variations of use of the present invention.
Figure 7B:
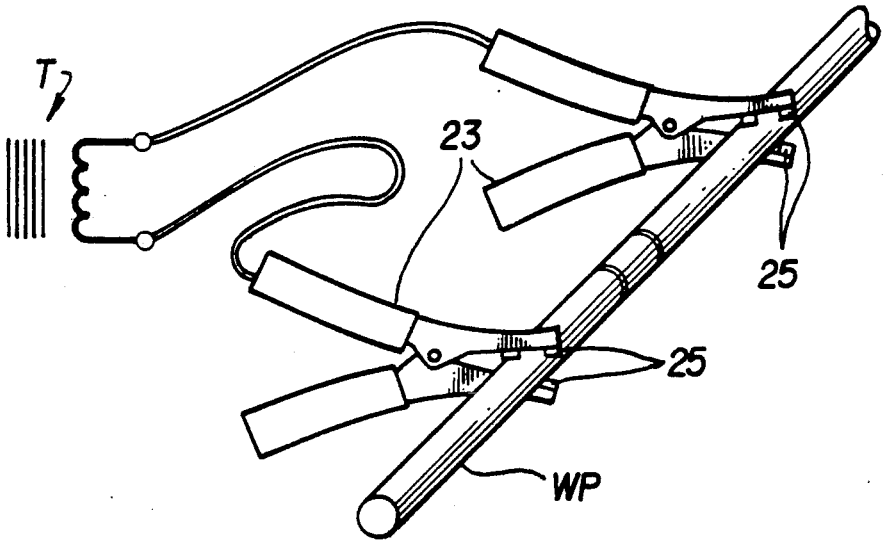
Figure 7C:
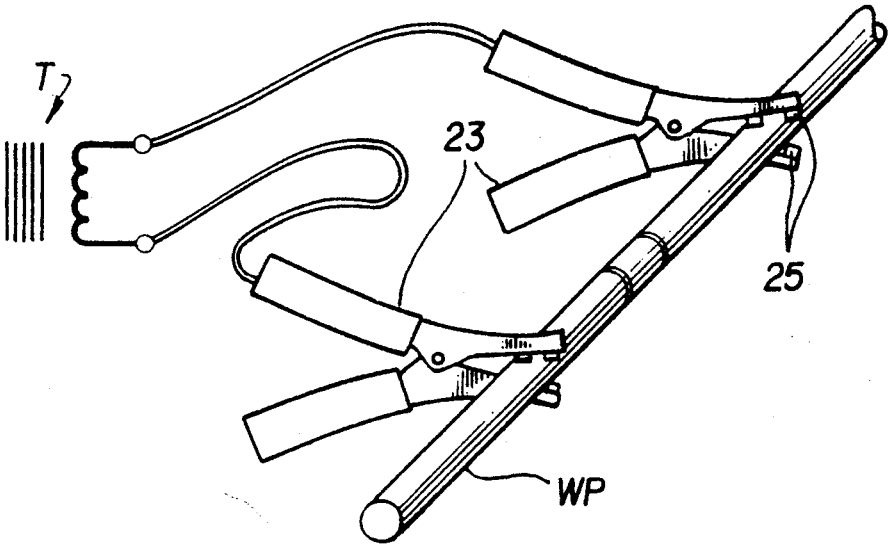
Figure 7D:
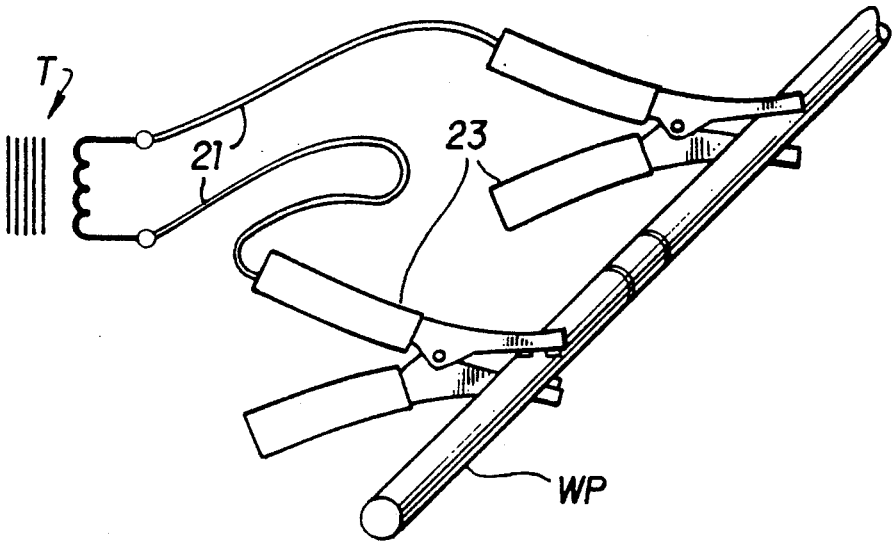

As seen in greater detail in FIGS. 6*a* and 6*b*, the heater blocks may be of various configurations in order to vary the contacting area of the heater block with the work-piece and hence the heater block's effective resistance. A two-contact heater block is shown in FIG. 6*a* whereas a six-contact heater block of greater effective resistance is shown in FIG. 6*b*. The heater blocks are preferably composed of carbon which exhibits decreasing resistance with increasing temperature, but may also be made of iron, nickel, aluminum, stainless steel, tungsten, or alloys thereof depending on the desired electrical resistance and thermal conductivity characteristics.

Although carbon is easy to shape and has an unusually high melting point temperature, it also undergoes rapid carbon oxidation with the air at heavy currents and high temperatures. Under such conditions, heat accumulates faster in the heater blocks than can be dissipated into the work-piece. As a result, the heater blocks burn slowly and the jaws of the clamps 23 may become excessively heated. The effective resistance, and the resulting current and temperatures generated in the heater blocks, are proportional to the amount of surface area of the heater blocks that is in contact with the work-piece. Thus, by minimizing the surface area of the heater blocks that is in contact with the work-piece, current and temperatures may be reduced, avoiding destruction of the heater blocks.

Although some $I^2R$ heat is generated over the total conducting length of both the heater blocks and the work-piece, the highest temperature source of heat is at the surface, i.e., the interface between each of the heater blocks and the workpiece. By minimizing the area of contact between each heater block and the work-piece, resistance at that interface is increased, which in turn increases the amount of heat generated at the interface. The area of contact may be minimized by forming a V-notch in the heater block or various configurations including those illustrated in FIGS. 6*a* and 6*b*.

Reducing the areas of contact will increase the resistance at the interface. However, it will also decrease the amount of current flow from a constant power source. Conversely, increasing the contact area will increase the current flow. Therefore, there must be a balancing as indicated in the $I^2R$ equation.

The contact resistance is also dependent upon the relative materials used. Each material has a resistivity which is symbolized by the Greek letter $\rho$ (rho). The electrical resistance of any given material is determined by the formula: $R=\rho\times(1/a)$, where R=resistance, p=resistivity, 1=length of the material, and a=cross-sectional area of the material. Since the principal source of heat is primarily at the points of contact, and since the areas of contact are exactly equal for both the work-piece and the heater block, the relative resistances between the heater block and the work-piece can be determined by comparing the resistivity of the material from which the heater block and the work-piece are formed.

For example, the resistivity for copper is approximately $1.724\times10^{-6}$ ohms $cm^3$, for carbon $3\times10^{-4}$ ohms/$cm^3$, and $10.0\times10^{-5}$ ohms/$cm^3$ for nichrome. Thus, for a carbon/copper interface, the ratio of resistivity is about $(3.0\times10^{-4}/1.724\times10^{-6})$, or 174. For a nichrome/copper interface the ratio of resistivity is about $(10.0\times10^{-5}/1.724\times10^{-6})$, or 58. If the work-piece and heater blocks are made of the same material, then the ratio is unity.

Figure 11A:
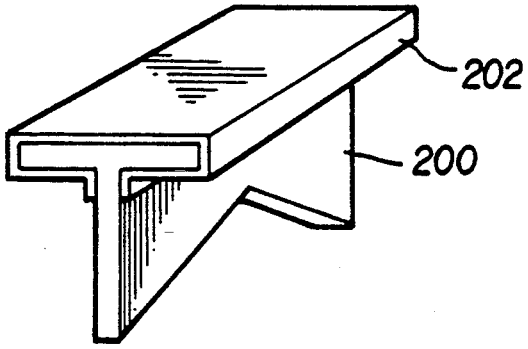
FIG. 11*a*, 11*b* and 11*c* are illustrations of heater blocks that may be used with the present invention.
Figure 11B:
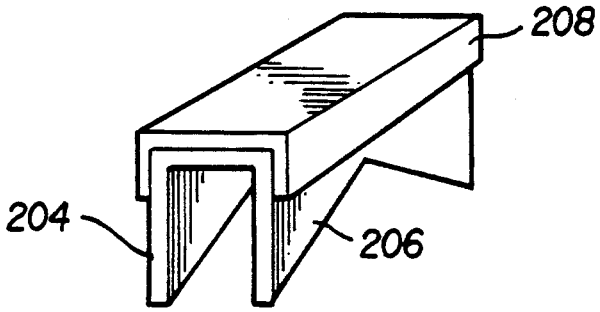
Figure 11C:
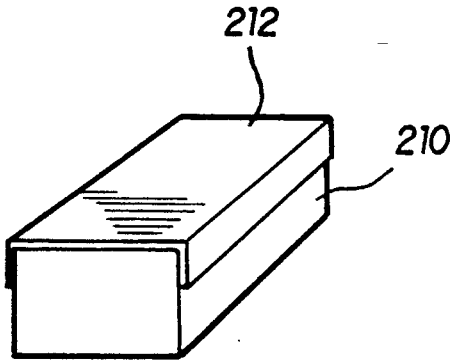

In FIGS. 11*a*, 11*b* and 11*c* various alternative designs for heater blocks are illustrated. For example, in FIG. 11*a*, a heater block having a V-notch is shown. The heater block includes a metal or metal alloy base 200 with a copper connection sheath 202 over a section thereof. In FIG. 11*b*, another heater block is shown having two parallel contact plates 204, 206 and a copper connection sheath 208 over a portion thereof. FIG. 11*c* illustrates a heater block having a base 210 comprised of a block packed from filaments, wires, lathe turnings, or similar strands of stainless steel, iron, nichrome, and other such metals and alloys. A copper sheath 212 may also be used with such an embodiment.

Figure 3:
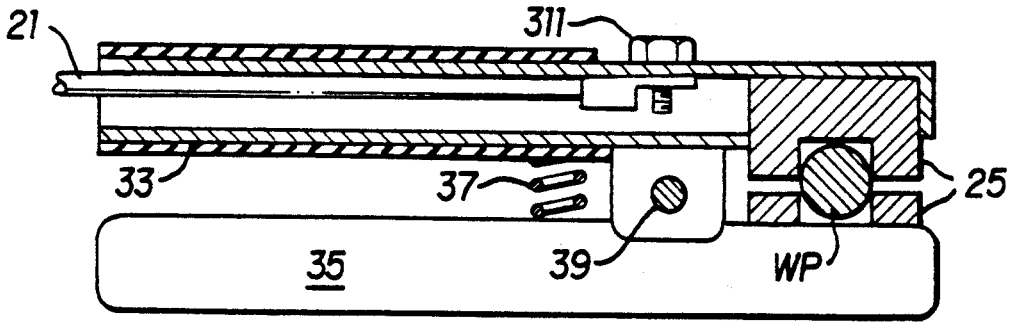
FIG. 3 is a sectional view of a cable connector clamp used in conjunction with the foregoing embodiment of the invention.

The construction of the clamp 23 is shown in greater detail in FIG. 3, wherein an upper insulated handle 33 and a lower insulated handle 35 are joined by a pivot shaft 39 and tensioned by a closing spring 37. The conductive cable 21 is secured inside the upper insulated handle by a cable connector bolt 311. Upper and lower carbon resistor blocks 25 are secured to the respective jaws of the clamp so as to surround the work-piece WP when the clamp is closed on the work-piece.

Figure 4:
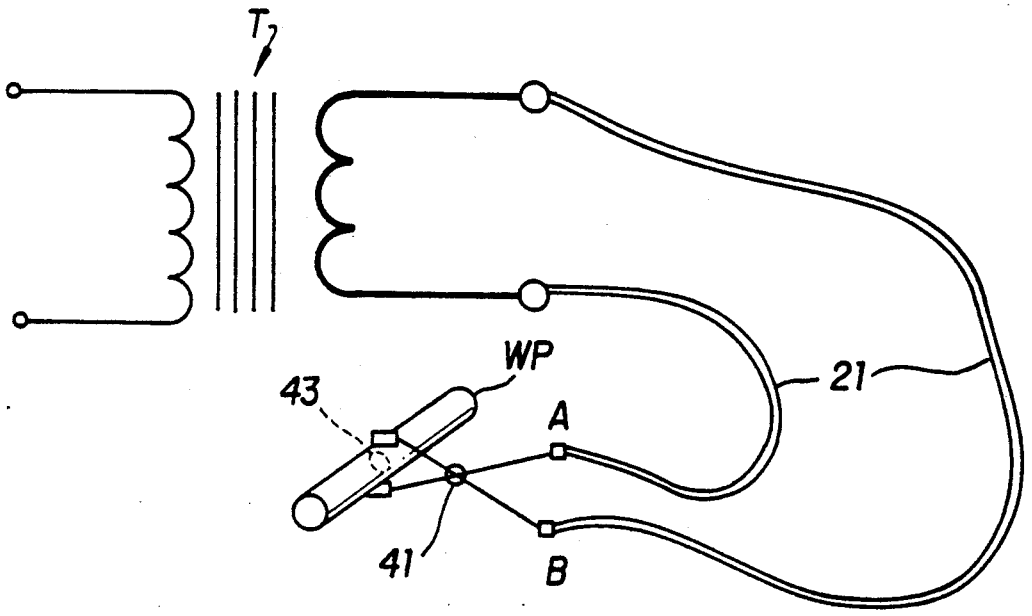
FIG. 4 is a circuit diagram of another embodiment of the present invention.
Figure 5:
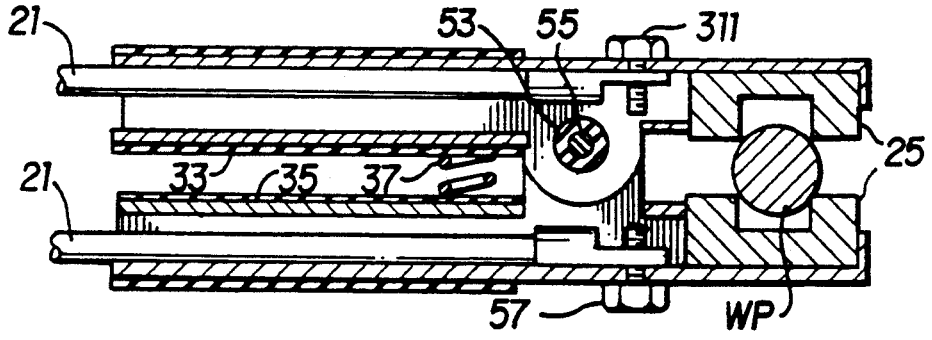
FIG. 5 is a sectional view of a cable connector clamp used in conjunction with the foregoing embodiment of the invention.

By insulating the clamp at its pivot point, electrically isolating its constituent levers, a single clamp may be used to form a complete circuit between the work-piece WP and the transformer T by connecting a separate cable 21 to each of the clamp levers, as shown in FIGS. 4 and 5. A first cable is connected to a terminal A formed by one of the constituent levers and a second cable is connected to a terminal B formed by the other of the constituent levers, the two levers being insulated at their pivot point 41. Instead of a portion of the work-piece between two different clamps being heated, as shown in FIG. 2, the portion of the work-piece heated in FIG. 4 is a localized area 43 between the two constituent levers of a single clamp.

Construction of the modified clamp may be understood with reference to FIG. 5. The upper and lower handles may be substantially identical to one another. In the FIG. 5 embodiment, a second conducting cable 21 is secured in the lower handle 35 of the clamp by a cable connector bolt 57. Pivot shaft insulators 53 and 55 electrically isolate the two sides of the clamp from one another.

In another example, a transformer having a 220 volt primary input and a 35 volt secondary output capable of delivering 100 amperes to a 3.5 kw resistance furnace load was used. The transformer was adapted for use by taking input power reduced to 25 to 60 volts and delivering about 5 to 15 volts from the secondary coil. A ½ inch copper pipe was used as the workpiece and an alligator clamp with two carbon resistor heater blocks fastened to the jaws was used to apply the current to the work-piece. With between 300 to 500 watts, the ½ inch copper pipe was soldered in about one minute or less.

Having described the various modifications of the present invention, it will be evident that numerous different working arrangements of the present invention are possible as illustrated in FIGS. *7a–7d*. In FIG. *7a*, a single clamp with an insulated pivot point 41 is used in conjunction with heater blocks 25. By addition of a finger or foot-operated switch 71, the current through the work-piece may be conveniently interrupted. In the case of a foot-operated switch, both of the operators hands remain free at all times during the operation.

In FIG. *7b*, two separate clamps 23 are used at spaced locations on the work-piece, each with heater blocks 25.

In FIG. *7c*, two separate clamps 23 are employed, but only one of them uses heater blocks 25. The remaining clamp forms a direct electrical connection with the work-piece.

In FIG. *7d*, two separate clamps 23 are used, both without heater blocks. In the FIG. *7d* embodiment, resistors $R_1$ and $R_2$ of FIG. 1 are effectively zero. It is assumed that the transformer T and the cables 21 are both sufficiently rated such that the resulting current does not exceed their current capacity.

Figure 8:
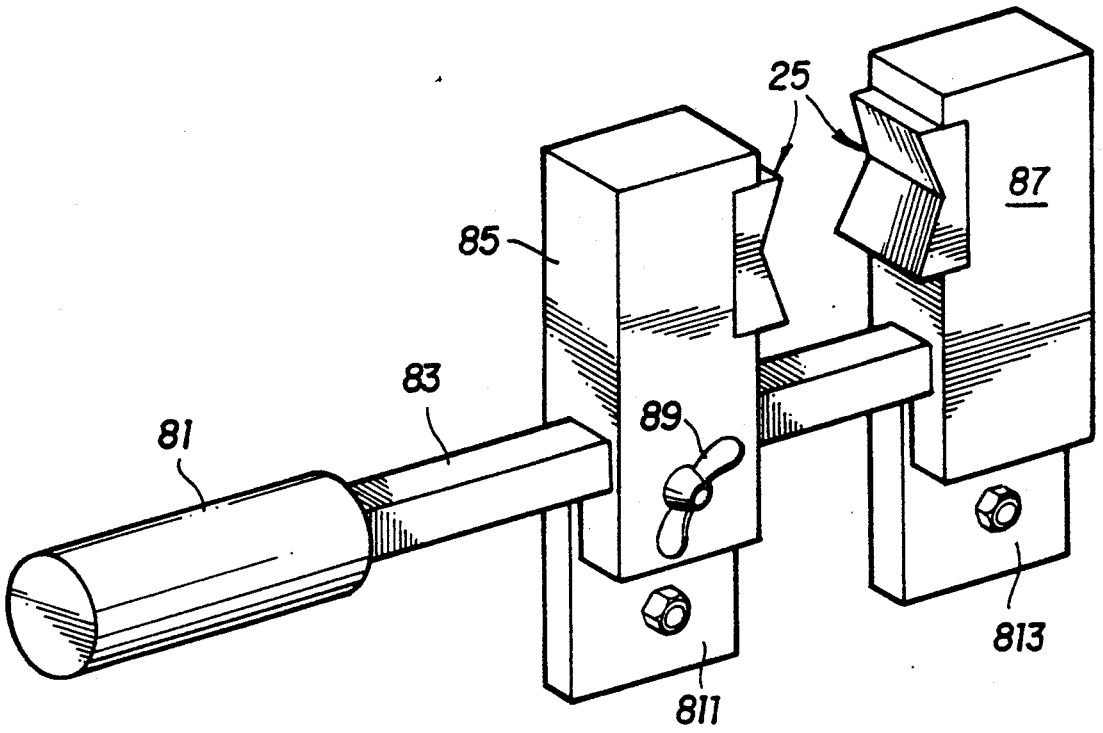
FIG. 8 is an illustration of a sliding clamp for use with the present invention.

A number of different types of clamps are suitable for use with the present invention in addition to the alligator-type clamp thus far described. A sliding clamp is shown in FIG. 8. Two opposing jaws 85 and 87 are mounted on a bar 83 provided with a handle 81. The jaw 87, for example, is fixedly attached to the bar 83 which is composed of an insulating material, whereas the jaw 85 is slidably attached to the bar 83 and fixed in place using a lock nut 89. Lugs 811 and 813 are provided on the respective jaws for connecting the first and second cables. Heater blocks 25 may be of a notched configuration and are mounted on the respective jaws 85 and 87.

Figure 9:
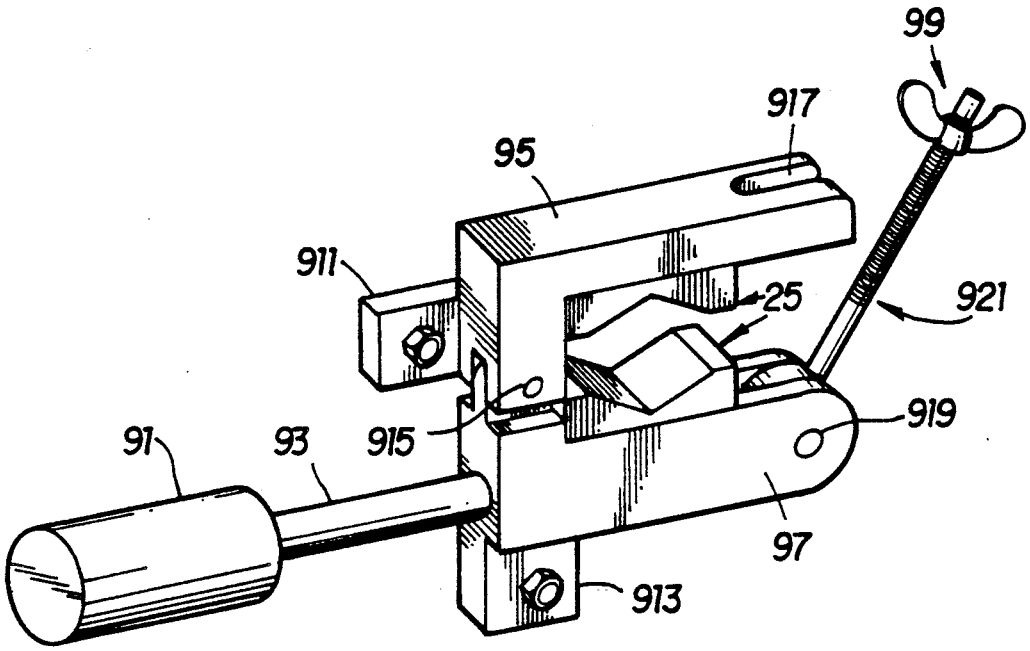
FIG. 9 is an illustration of a hinged clamp for use with the present invention.

According to another variation shown in FIG. 9, the clamp may be of the hinged type having two opposing jaws 95 and 97 connected by a hinge 915. The jaw 95 is fixedly attached to a rod 93, which is mounted to a handle 91. Each of the jaws 95, 97 are provided with respective lugs 911 and 913 for connecting cables to the clamp. Heater blocks 25 are provided on each jaw 95, 97. The clamping mechanism, however, uses a hinged bolt 921 that may swing into a slot 917 in the jaw 95 and can be tightened by a butterfly nut 99 for clamping. The hinge 915 is insulated so that jaws 95 and 97 are not in electrical contact with each other. Thus, both cables can be attached to a single clamp.

Figure 10A:
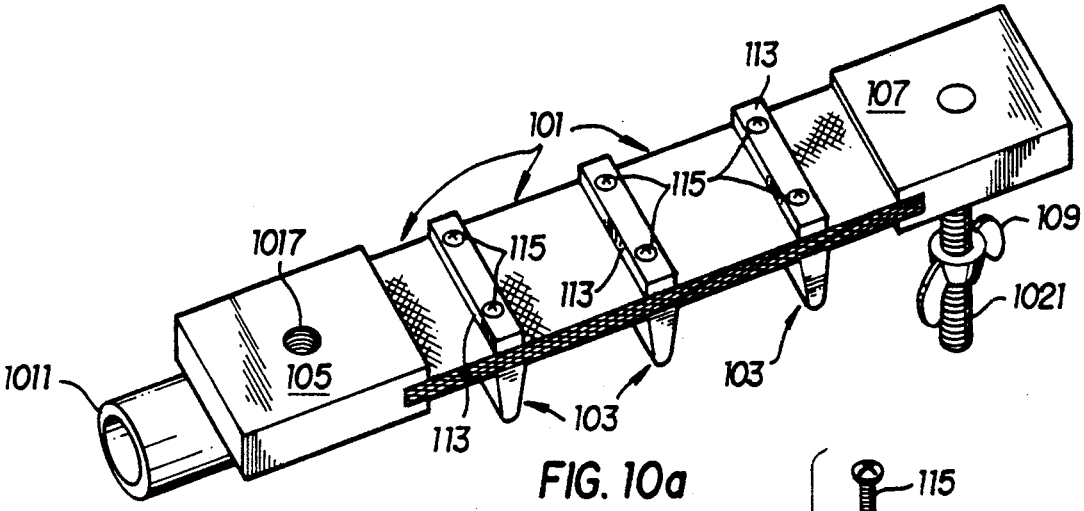
FIGS. 10*a*–10*e* are illustrations of strap connector for use with the present invention.
Figure 10B:
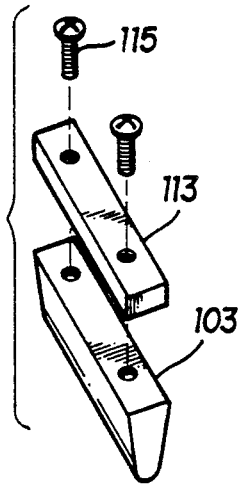

A strap-type connector of FIG. 10 is designed to connect to a single cable only and has as its principal parts shown in FIG. 10*a* flat braided wire strap 101, preferably of copper, connected between end blocks 105 and 107, also preferably of copper. Attached at intervals along the wire strap are heater blocks 103. The end block 105 is provided with a through hole 1017 and a cable lug 1011. The end block 107 is provided with a clamping bolt 1021 and a butterfly nut 109.

Each of the heater blocks 103 is attached to the wire strap 101 by means of a top plate 113 and a pair of machine screws 115. As more clearly seen in FIG. 10*d* showing a section of the heater block assembly taken lengthwise through the wire strap and FIG. 10*e* showing a section of the same assembly taken widthwise through the strap, the machine screws 115 extend through holes in the top plate 113 and the wire strap 101 and are secured into threaded holes in the heater block 103 itself.

Figure 10C:
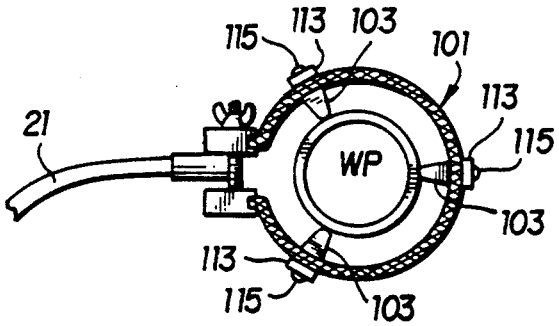
Figure 10D:
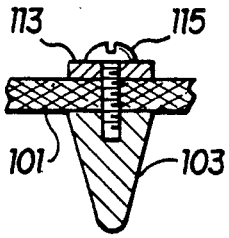
Figure 10E:
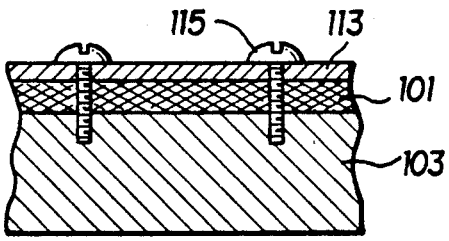

In use, as shown in FIG. 10*c*, the wire strap 101 is wrapped around the work-piece WP and the heater blocks are positioned in contacting relation thereto The clamping bolt 1021 fixed to block 107 is then passed through the through hole 1017 in block 105 and the butterfly nut 109 is tightened so that the strap becomes taut and snugly retains the heater blocks 103 against the work-piece WP. A cable 21 is electrically mounted to the lug 1011 which is fixed to end block 105. To complete the circuit, another clamp of the same type, or a clamp of any of the foregoing types, may be fastened to the work-piece at a location such that the portion of the work-piece to be heated is straddled by the two clamps.

By means of the present invention, a work-piece may be rapidly and efficiently heated by passing heavy currents through the work-piece itself to generate heat from the $I^2R$ effects rather than relying only on heat transfer to conduct heat from adjacent electric heaters. When current limiting is required, such limiting may be accomplished by using resistive electrodes which, besides supplying current to the work-piece, are placed in intimate thermal contact with the work-piece and thus supply additional heat to the work-piece by thermal transfer a such heat is developed in the resistive electrodes. By preferring direct generation of heat in the work-piece and relying on secondary thermal transfer only to the extent necessary, improved results may be achieved as compared with the prior art.

Figure 12:
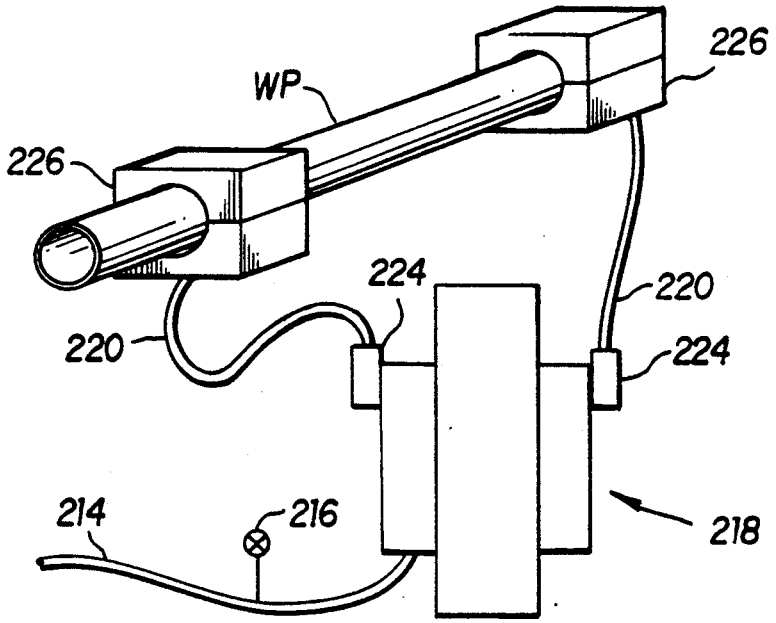
FIG. 12 is a view of an alternative embodiment of the present invention.

In FIG. 12 an alternative embodiment using short cables is illustrated. A power cord 214 supplies power through a switch 216 to a transformer 218. Short cables 220 are connected between secondary terminals 224 on the transformer 218 and heater blocks 226. The heater blocks 226 are fastened to a work-piece WP for heating. The cables 220 may be permanently fastened to the transformer. The heater blocks 226 may be of any of the kinds described previously in this application. Such an arrangement can be set up near the work-piece WP, thus allowing for the use of short cables 220. Short cables 220 are advantages in that they cause less $I^2R$ voltage drop in the cables themselves.

Figure 13:
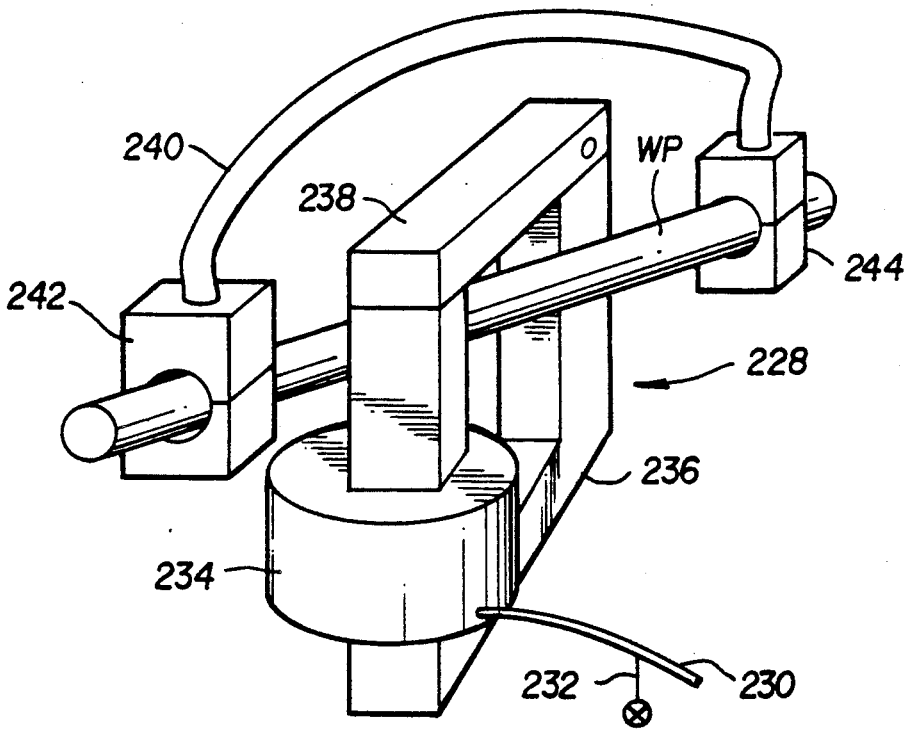
FIG. 13 is a view of another embodiment of the present invention.

FIG. 13 illustrates another embodiment of the present invention. In this embodiment, the work-piece WP functions as a portion of a one-turn secondary coil of the transformer 228. A power cord 230 and switch 232 supply power to a primary coil 234 of the transformer. The core 236 of the transformer 228 has a hinged gate 238 that can be pivoted to an open position so a work-piece WP may be placed within the core 236. A cable 240 electrically connects two connector blocks 242, 244. In such an arrangement, the work-piece WP, the connector blocks 242, 244, and the cable 240 constitute the secondary coil of the transformer. Any of the heater blocks described previously in this application may be used in this embodiment.

It is preferable that one of the connector blocks 244 is designed so as to make a large area contact with the work-piece WP so as to minimize heat development at that connection. The other connector block 242 is designed in accordance with the principles of the present invention so as to maximize heat development.

It will be appreciated by those of ordinary skill in the art that the present invention can be embodied in other specific forms without departing from the spirit or essential character thereof. The scope of the invention is indicated by the appended claims rather than the foregoing description, and all changes which come within the meaning and range of equivalents thereof are intended to be embraced therein.

What is claimed is:

1. An apparatus for heating a substantially cylindrical electric conductor of a given radius comprising:

a power supply;

current-flow-path means connected to said power supply for carrying a current flow through said conductor; and a pair of resistive electrode means connected to said current-flow-path means for supplying current and heat to said conductor, each of said resistive electrode means being of a configuration having at least two angles of substantially 90° or less forming two substantially parallel edges spaced apart a distance greater than said given radius but less than twice said given radius; and means for clamping said resistive electrode means in opposition about said conductor.

2. The apparatus of claim 1, wherein said resistive electrode means are carbon.

3. The apparatus of claim 1, wherein said resistive electrode means are one of iron, nickel, aluminum, stainless steel, and tungsten.

4. The apparatus of claim 1, wherein said current-flow-path means comprises a pair of cables terminated with a single clamp having opposing jaws joined at an insulated pivot.

5. The apparatus of claim 1, wherein said power supply comprises a power transformer having a high-voltage, low-current primary winding and a low-voltage, high-current secondary side.

6. The apparatus of claim 5, wherein said power supply further comprises a finger-operated switch connected on the primary side of said transformer.

7. The apparatus of claim 5, wherein said power supply further comprises a foot-operated switch connected on the primary side of said transformer.

8. The apparatus of claim 1, wherein the resistances of the resistive electrodes are adjustable.

9. The apparatus of claim 1, wherein said resistive electrode means comprises a metal base and a copper sheath covering a portion of the base.

* * * * *